US005565677A

United States Patent [19]

Wexler et al.

[11] Patent Number: 5,565,677

[45] Date of Patent: Oct. 15, 1996

[54] AERODYNAMIC NOZZLE FOR AEROSOL PARTICLE BEAM FORMATION INTO A VACUUM

[75] Inventors: Anthony S. Wexler; Murray V. Johnston, III; Ramakrishna Mallina, all of Newark, Del.

[73] Assignee: The University of Delaware, Newark, Del.

[21] Appl. No.: 511,549

[22] Filed: Aug. 4, 1995

[51] Int. Cl.[6] ..... H01J 41/04

[52] U.S. Cl. ..... 250/251; 250/288

[58] Field of Search ..... 250/251, 281, 250/282, 288, 288 A; 55/318, 322, 392; 73/28.04

[56] References Cited

U.S. PATENT DOCUMENTS 4,383,171 5/1983 Sinha et al. ..... 250/288

5,270,542 12/1993 McMurry et al. ..... 250/251

*Primary Examiner*—Jack I. Berman
*Assistant Examiner*—Kiet T. Nguyen
*Attorney, Agent, or Firm*—Connolly & Hutz

[57] ABSTRACT

An aerodynamic nozzle for aerosol particle beam formation into a vacuum comprises a tubular column having a first stage section with a plurality of spaced aerodynamic lenses therein so that an aerosol entering the inlet end of the first stage section is formed into a beam of generally aligned particles. The beam exits the first stage section through an outlet orifice into a second stage section also having a plurality of spaced aerodynamic lenses to maintain the aerosol in its beam form. The beam then exists through a nozzle to an orifice at the discharge end of the second stage section into an evacuated region. The pressure decreases from the first stage (which is preferably at atmospheric pressure) to the second stage to the evacuated region.

21 Claims, 2 Drawing Sheets

AERODYNAMIC NOZZLE FOR AEROSOL PARTICLE BEAM FORMATION INTO A VACUUM

GOVERNMENT LICENSE RIGHTS

The U.S. Government has a paid-up license in this invention and the right in limited circumstances to require the patent owner to license others on reasonable terms as provided for by the terms of ATM-9122291 awarded by NSF.

BACKGROUND OF THE INVENTION

There is an interest in detecting and analyzing aerosol particles. For example, evidence indicates that there is a correlation between acid aerosol inhalation and lung impairment. A number of instruments have recently been developed in the United States and other countries attempting to detect and analyze the aerosol particles. These applications span conductor processing to air pollution research. There are, however, currently no available methods for taking a particle— gas mixture (an aerosol), forming a particle beam where all the particles are aligned, and then introducing the beam into a vacuum. The introduction into a vacuum is desired because a vacuum is convenient for counting the particles or assessing their chemical composition.

SUMMARY OF THE INVENTION

An object of this invention is to provide a nozzle which accomplishes the above needs.

A further object of this invention is to provide such a nozzle which performs its task with 100% transmission efficiency wherein essentially all of the particles that enter the nozzle exit into the vacuum in a particle beam.

In accordance with this invention, an aerodynamic nozzle is provided for aerosol particle beam formation into a vacuum. The nozzle comprises a tubular column having a first stage section with an aerosol inlet end and an orifice at its outlet end. A plurality of spaced aerodynamic lenses is provided in the first stage section to cause the flow of aerosol to form a beam of generally aligned particles. The outlet orifice of the first stage section is in flow communication with a second stage section also having a plurality of spaced aerodynamic lenses to maintain the aerosol in its beam form so that the aerosol exits through the orifice of the second stage section in beam form into an evacuated region. Preferably the first stage section is under atmospheric pressure, while the second stage section is under a lower pressure greater than the pressure in the evacuated region.

In accordance with a preferred practice of this invention each of the first and second stage sections include lenses in the form of discs having axial openings which form a path through which the aerosol beam flows. A plurality of the lenses in each stage section is arranged a series wherein the diameters of the openings progressively decrease in the downstream direction. The outlet orifices are formed in capillaries at the downstream end of each of the first stage and the second stage sections. Preferably much of the gas is removed from the aerosol at the inlet to the second stage section by the pump which lowers the pressure of the second stage section.

A BRIEF DESCRIPTION OF THE DRAWINGS

DETAILED DESCRIPTION

The present invention is directed to an aerodynamic nozzle which takes a stream of aerosol as a particle-gas mixture and forms a particle beam where all of the particles are aligned. The beam is then introduced into a vacuum where the particles could be counted or where the particles could have their chemical composition assessed. The present invention is based upon an understanding of particle flow to overcome the tendency of particles to diverge as the particles flow in a downstream direction. In accordance with the invention this tendency to diverge is overcome thereby forming the particle beam.

Figure 1:
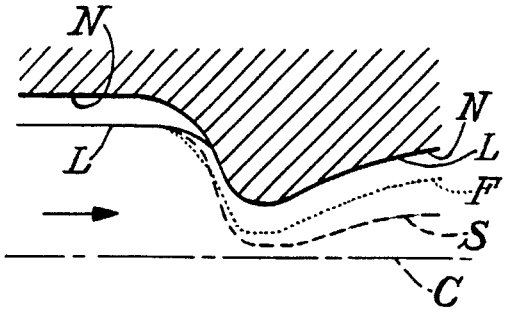
FIG. 1 is a schematic representation of particle trajectories at the entrance of a nozzle.

FIG. 1 schematically illustrates particle trajectories at the entrance of a nozzle. As shown therein the nozzle boundary is indicated by N and its centerline by C. The large particles L due to their higher inertia get deposited on the walls of the inlet as the particles flow in the direction of the arrow. The large particles L that enter the source region exit the nozzle with small divergence due to their large inertia. The small particles S flow closer to the centerline C, but also tend to diverge. The fluid streamline F is also shown in FIG. 1.

Figure 2:
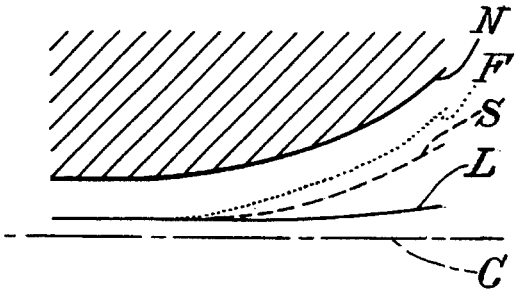
FIG. 2 is a schematic representation of particle trajectories at the nozzle exit.

FIG. 2 shows the particle trajectories at the nozzle exit. Note that the small particles S due to their smaller inertia, enables them to be transmitted with minimal deposition losses, but this small inertia enables the carrier gas F to drag these particles to a greater extent during expansion. The large particles L are closer to the centerline C of the nozzle N.

Figure 3:
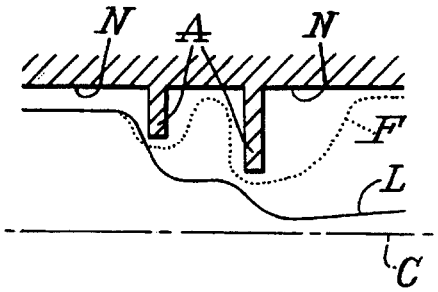
FIG. 3 is a schematic representation of particle trajectory with aerodynamic lenses in the nozzle.

FIG. 3 illustrates the incorporation of features of the invention to more favorably affect the flow. As shown therein before large particles L are sent into the nozzle N they are preconditioned with aerodynamic lenses A. An aerodynamic lens consists of an axisymmetric reduction or enlargement in a tubular cross-section. Such lenses are described, for example, in Liu, P., Ziemann, P., Kittelson, D. B., and McMurry, P. H. (May 28–29, 1993); Delft University of Technology, Delft, Holland; *Workshop on Synthesis and Measurement of Ultrafine Particles* and in McMurry U.S. Pat. No. 5,270,542, the details of which are incorporated herein by reference thereto. By using one or more lenses A upstream of the nozzle, particles can be moved arbitrarily close to the centerline C without using supplemental sheath air. FIG. 3 thus shows the trajectory of the large particles L to be moved close to the centerline C under the influence of the aerodynamic lenses A. The fluid stream line F, however, continues to flow close to the inlet boundary N of the nozzle.

Figure 4:
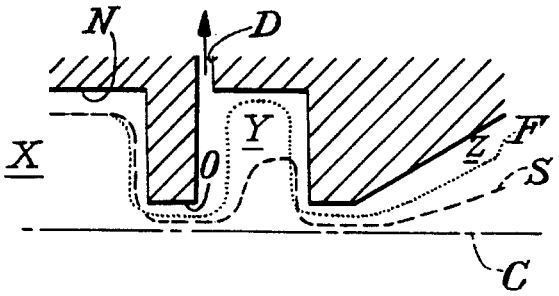
FIG. 4 is a schematic representation of particle trajectory in differential pumping.

FIG. 4 shows the particle trajectory in differential pumping. As shown therein, the nozzle N includes a first stage X which is, for example, at atmospheric pressure (760 torr). The nozzle also includes a second stage Y at a reduced pressure of, for example, 50 torr. The pressure is reduced by providing a suitable pump at a location D downstream from the orifice O formed in a capillary at the outlet end of first stage X. An evacuated region Z having a pressure of, for example, 0.01 torr is located downstream from the second stage Y. To reduce divergence, the small particles in stream S exit at a low pressure such that the drag on the particles is minimized. The expansion of the carrier gas F is dependent on the pressure ratio. To keep this ratio low the expansion is carried out in stages. See Seapan, M., Selman, D., Seale, F., Sibers, G., and Wissler, E. H. (1982); *Journal of Colloid and Interface Science;* 87:154–166. As shown in FIG. 4, the small particles S flow in a stream closer to the centerline C than the fluid streamline F.

Figure 5:
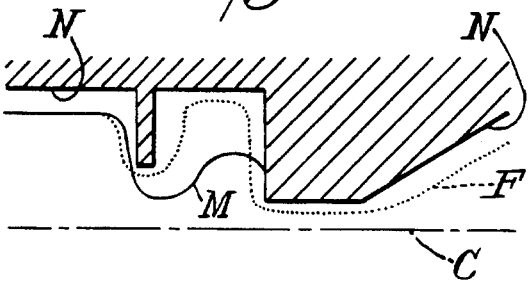
FIG. 5 is a schematic representation of particle trajectory for a medium sized particle without a transitional nozzle.
Figure 6:
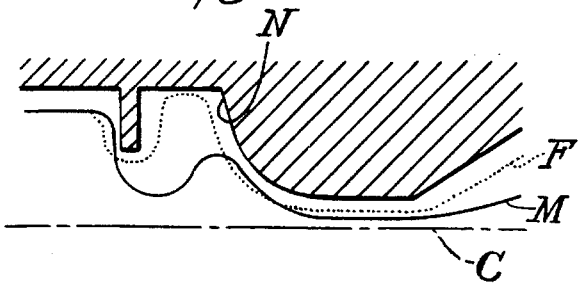
FIG. 6 is a schematic representation of particle trajectory for a medium sized particle with a transitional nozzle.

FIG. 5 illustrates the particle trajectory for a medium sized particle without having a transitional nozzle. As shown therein the path of flow of the medium particle is indicated by the letter M. Particles which have significant deposition losses and form beams without a substantial divergence require a nozzle which is properly shaped. FIG. 6 illustrates a transitional nozzle N which is designed based upon a quasi one-dimensional compressible flow model similar to the works of Israel and Whang (Israel, G. W., and Whang, J. S. (1971); Institute for Fluid Dynamics and Applied Mathematics, University of Maryland; *Technical Note BN*-709) and Dahneke and Cheng (Dahneke, B. E., and Cheng, Y. S. (1979); *Journal of Aerosol Science;* 10:257–166. As shown in FIG. 6 the flow of the medium sized particle M is maintained close to the centerline C with the transitional nozzle in contrast to FIG. 5 where the flow of the medium sized particle M is along the inlet boundary N.

Figure 7:
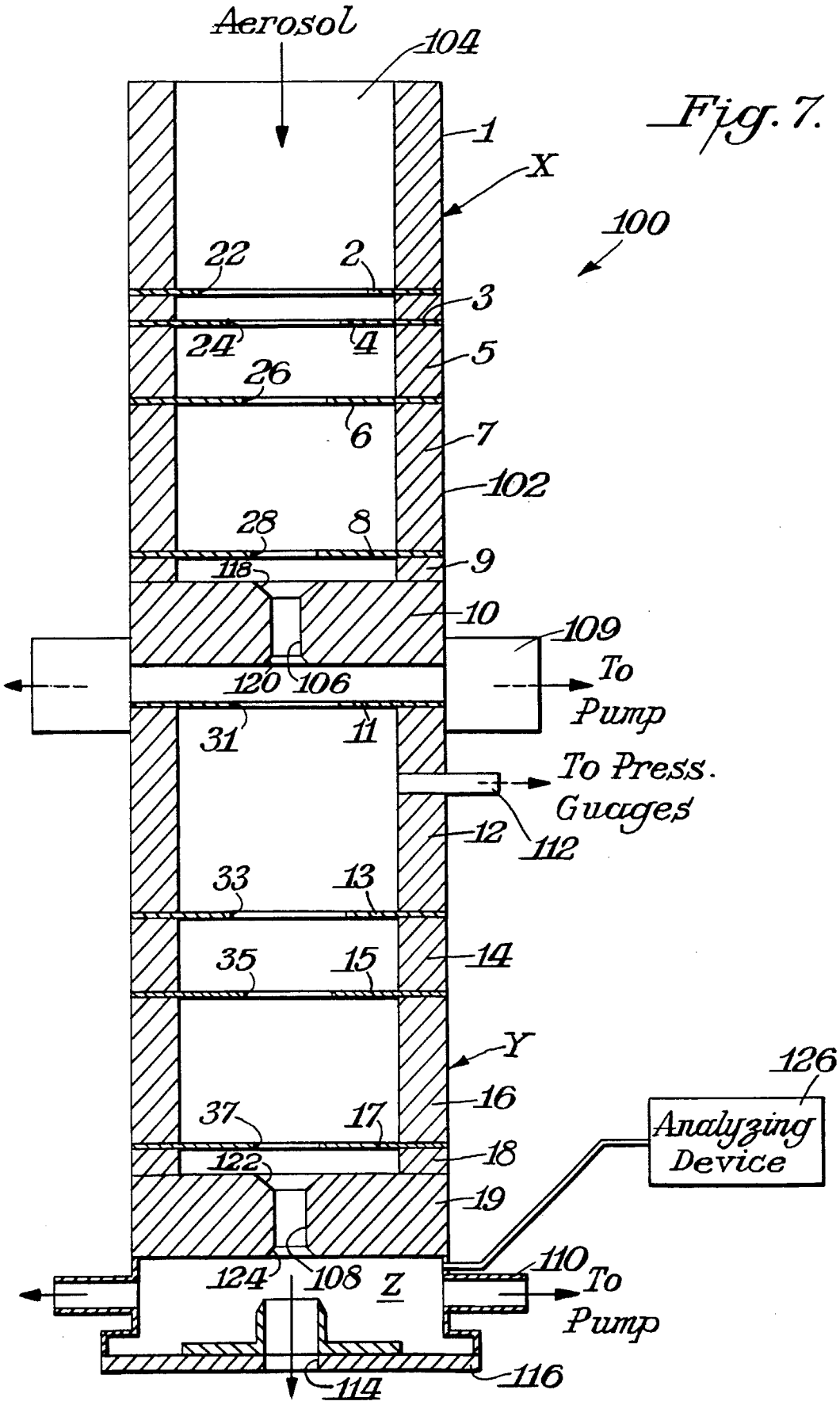
FIG. 7 is a cross-sectional view of an aerodynamic nozzle in accordance with this invention.

FIG. 7 illustrates an aerodynamic nozzle 100 in accordance with this invention. As shown therein the nozzle 100 is in the form of a tubular column 102 having a first stage section X and a second stage section Y with an evacuated region Z being downstream from second stage section Y.

As shown in FIG. 7 a plurality of aerodynamic lenses 2, 4, 6 and 8 is mounted in series in first stage section X between the respective tubular segments 1, 3, 5, 7 and 9 of the first stage section. Each lens is in the form of a disc having an axial opening or aperture. The openings 22, 24, 26 and 28 in the respective lenses 2, 4, 6, 8 are of decreasing diameter in a downstream direction. Thus, the aerosol entering the inlet end 104 of column 102 passes through progressively smaller openings or paths in the lenses for flow past the lenses. The spacing between the lenses 2, 4, 6 and 8 also increases in a downstream direction. First stage section X is preferably at atmospheric pressure. Because of the provision of the lenses 2, 4, 6 and 8 the atmospheric pressure aerosol is formed into a particle beam where all of the particles are aligned. The beam then passes through an orifice 106 in the capillary 10 at the downstream end of first stage section X. The diameter of the orifice 106 is less than the diameter of aperture 28 in downstream-most lens 8.

A pump (not shown) is in flow communication with the second stage section Y at the inlet end of second section Y near orifice 106. The pump functions to reduce the pressure to an intermediate pressure, such as 50 torr in the second stage section Y. In addition much of the gas in the aerosol flow is removed by the pump before the path enters the second stage section Y.

The second stage section Y also includes a plurality of aerodynamic lenses 11, 13, 15 and 17 similar to the lenses in the first stage section. Lens 11 is located at the inlet end of second stage section Y above segment 12. Lenses 13, 15 and 17 are located between respective pairs of segments 12, 14, 16 and 18 as shown in FIG. 7. The diameter of openings 33, 35 and 37 in the series of lenses 13, 15 and 17, respectively, decreases in a downstream direction. The diameter 31, however, of the opening in upstream-most lens 11 may be larger than the opening diameter of its next downstream lens 13 and larger than orifice 106 and of the opening 28 in downstream-most lens 8 of the first stage section X. The provision of the lenses in the second stage section Y also functions to maintain the aerosol in a particle beam form. The spacing between lenses 13, 15 and 17 is also shown to gradually increase in the downstream direction. The particle beam passes through orifice 108 in capillary 19 as shown in FIG. 7.

After the particle beam passes through orifice 108, the particle beam enters the evacuated region Z. Region Z is evacuated by a pump through pump connection 110 which functions to reduce the pressure in region Z to, for example, 0.01 torr and also to remove carrier gas remaining in the particle beam. Thus, the nozzle forms a particle beam wherein the atmospheric pressure aerosol is brought through aerodynamic lenses and through an orifice into a region of intermediate pressure. Much of the gas is removed through outlet 109 and the remaining particles are passed through another set of aerodynamic lenses and another orifice before entering the evacuated region.

The orifice 106 in capillary 10 has an inclined entrance wall 118 and an inclined exit wall 120. Similarly, the orifice 108 in capillary 19 has an inclined entrance wall 122 and an inclined exit wall 124 to facilitate the flow of the beam through each respective orifice.

Second stage section Y may be provided with a pressure gauge 112 to confirm that the second stage section is under the proper intermediate pressure.

The beam in the evacuated region Z may then be subjected to conventional techniques by analyzing device 126 for detecting and analyzing the aerosol particles afterwards the beam passes through outlet 114 in skimmer 116. A suitable analyzing device is described in U.S. Pat. No. 4,383,171, the details of which are incorporated herein by reference thereto. On-line chemical analysis of single aerosol particles can be done by using rapid single-particle mass spectroscopy (RSMS). Aerosols are sampled directly into a mass spectrometer where individual particles are detected by light scattering from a continuous laser beam. The scattered radiation from each particle triggers an excimer laser which ablates the particle in-flight. Ions produced from the particle are analyzed by time-of-flight mass spectrometry. The chemical composition of the particles is inferred from the distribution of ions in the mass spectrum. The device is efficiently transmitting a wide range of aerosol particle sizes to an evacuated source region without transmitting the carrier gas. The particles are not only to be transmitted efficiently, but also in a narrow beam.

The invention has the advantage of utilizing aerodynamic lenses to accomplish the task of particle beam formation which is accomplished at low pressure. By using two stages of lenses and orifices the nozzle 100 enables particles in atmospheric pressure gases to be introduced efficiently into a vacuum. The aerodynamic lenses are quite effective in moving large particles to the centerline of the nozzle. Beam divergence of small particles can be reduced by using a differentially pumped inlet. The deposition losses for medium size particles can be reduced using a transitional nozzle. Using numerical tools the inlet is designed to transmit particles in the range 1.0–10.0 μm with near 100% efficiency. The resulting beam has the highest divergence for 1.0 μm size particles. The beam was about 500 μ across 5 cm downstream of a 400 μm nozzle exit.

Any suitable number of aerodynamic lenses may be used in each stage section. Preferably the set of lenses in each section include a plurality, such as two or more lenses arranged in series where the size of the open area forming a path of flow past each lens for the beam decreases in the downstream direction. Preferably the lenses are discus having axial openings which form the paths. As shown in FIG. 7 the set of lenses may also include at least one lens in addition to the series having the decreasing diameter relationship.

Nozzle 100 and its components may be of any suitable materials and dimensions. In a preferred practice of this invention, each stage section has a length of 5.3 inches. The inside diameter in the first and second stage sections is 0.394 inches. Lens 2 has an aperture diameter of 0.326 inches. Lens 4 has an aperture diameter of 0.208 inches. Lens 6 has an aperture diameter of 0.120 inches. Lens 8 has an aperture diameter of 0.102 inches. Lens 2 is spaced from lens 4 by a distance of 0.19 inches. Lens 4 is spaced from lens 6 by a distance of 0.395 inches. Lens 6 is spaced from lens 8 by a distance of 0.785 inches. The lenses is 0.04 inches thick. Similarly, lens 13 is spaced from lens 15 by a distance of 0.395 inches and lens 15 is spaced from lens 17 by a distance of 0.785 inches. Lens 8 is spaced from capillary 10 and lens 17 is spaced from capillary 19, each by a distance of 0.435 inches. Lens 11 may has an aperture diameter of 0.158 inches. Each capillary 10,19 has a thickness of 1.190 inches with the tapered wall 118,122 extending downwardly 0.160 inches and inclined surfaces 120,124 may extend inwardly a distance of 0.005 inches in an axial direction.

In accordance with this invention the aerodynamic lenses are utilized to accomplish the task of particle beam formation, but this is accomplished only at low pressure. By using two stages of lenses and orifices the nozzle of this invention enables particles in atmospheric pressure gases to be introduced efficiently into a vacuum.

What is claimed:

1. An aerodynamic nozzle for aerosol particle beam formation into a vacuum comprising a column having a longitudinal passageway for flow of the aerosol therethrough, said column having a first stage section for concentrating larger particles, said first stage section having an upstream inlet end into which the aerosol is supplied and a downstream outlet end having an outlet orifice, at least one aerodynamic lens in said first stage section, said aerodynamic lens having an open area in said longitudinal passageway providing a path for the aerosol to flow past said lens for forming the aerosol into a beam having substantially aligned particles, said column having a second stage section downstream from said first stage section for concentrating smaller particles, said second stage section having an upstream inlet end in flow communication with said orifice of said first stage section for flow of the aerosol into said second stage section, said second stage section having an outlet end with an outlet orifice, at lest one aerodynamic lens in said second stage section, said aerodynamic lens having an open area in said longitudinal passageway providing a path for the aerosol to flow past said lens for maintaining the aerosol in the form of a beam, said second stage section being at a lower pressure than the pressure in said first stage section, an evacuated region downstream from and in flow communication with said orifice of said second stage section, and said evacuated region being at a lower pressure than the pressure in said second stage section.

2. The nozzle of claim 1 wherein a pump is connected to said column between said orifice of said first stage section and said inlet end of said second stage section, and gas being removed from the aerosol flow at the location between said orifice of said first stage section and said inlet end of said second stage section.

3. The nozzle of claim 2 wherein said first stage section is under atmospheric pressure.

4. The nozzle of claim 3 wherein a plurality of said aerodynamic lenses is in said first stage section.

5. The nozzle of claim 4 wherein said plurality of aerodynamic lenses includes at least two lenses arranged in series with the area of the path of said lenses decreasing in a downstream direction, and the cross-sectional area of said discharge orifice of said first stage section being less than the area of said path of the upstream lens closest to said orifice.

6. The nozzle of claim 5 wherein said second stage section has a plurality of said aerodynamic lenses including at least two lenses arranged in series with the area of the path of said series of lenses decreasing in a downstream direction, and the cross-sectional area of said discharge orifice of said second stage section being less than the area of said path of the upstream lens closest to said orifice.

7. The nozzle of claim 6 wherein the upstream-most lens at said inlet end of said second stage section has the area of its path larger than the area of the next lens in the downstream direction.

8. The nozzle of claim 7 wherein said lenses of said first stage section comprise at least four aerodynamic lenses all of which are in said series, said lenses of said second stage section comprising at least four lenses, said upstream-most lens of said second stage section having a path with an area smaller than the remainder of said second stage section lenses, and said remainder of said second stage lenses being in said series.

9. The nozzle of claim 8 wherein each of said outlet orifices is a passage through a capillary, a pump being in communication with said evacuated region for reducing the pressure in said evacuated region, and an analyzing device for testing the particles in said evacuated region.

10. The nozzle of claim 9 wherein said column is tubular, each of said lenses being of disc shape with an axial opening, and said axial opening being said path.

11. The nozzle of claim 1 wherein a plurality of said lenses is in at least one of said sections, said aerodynamic lenses including at least two lenses arranged in series with the area of the path of said lenses decreasing in a downstream direction, and the cross-sectional area of said discharge orifice of said first stage section being less than the area of said path of the upstream lens closest to said orifice.

12. The nozzle of claim 1 wherein said column is tubular, each of said lenses being of disc shape with an axial opening, and said axial opening being said path.

13. The nozzle of claim 1 wherein said outlet orifice in each of said sections has an inwardly inclined entrance which decreases in cross-sectional area to a cross-sectional area being less than the area of said path of the upstream lens closest to said orifice.

14. The nozzle of claim 13 wherein said outlet orifice in each of said sections has an outwardly inclined exit.

15. An aerodynamic nozzle for aerosol particle beam formation into a vacuum comprising a column having a longitudinal passageway for flow of the aerosol therethrough, said column including a longitudinal section having an upstream inlet end into which the aerosol is supplied and a downstream outlet end having an outlet orifice, a plurality of spaced aerodynamic lenses in said longitudinal section, each of said aerodynamic lenses having an open area in said longitudinal passageway to provide a path for the aerosol to flow past each of aerodynamic lenses, said aerodynamic lenses functioning to maintain the aerosol into a beam of substantially aligned particles, an evacuated region in flow communication with said orifice into which the beam flows after passing through said orifice, said evacuated region being at a lower pressure than the pressure of said longitudinal section, said plurality of aerodynamic lenses including at least three lenses arranged in series with the area of the path of said lenses decreasing in a downstream direction and said discharge orifice having an inwardly inclined entrance which decreases in cross-sectional area to a cross-sectional area being less than the area of said path of the upstream lens closest to said orifice.

16. The nozzle of claim 15 wherein the upstream-most lens at said inlet end of said longitudinal section has the area of its path smaller than the area of the next lens in the downstream direction.

17. The nozzle of claim 16 wherein said lenses comprise at least four lenses, said upstream-most lens having a path with an area smaller than the remainder of said lenses, and said remainder of said lenses being in said series.

18. The nozzle of claim 15 wherein said lenses comprise at least four lenses all of which are in said series.

19. The nozzle of claim 15 including an analyzing device for testing the particles in said evacuated region.

20. The nozzle of claim 15 wherein a pump is connected to said section for reducing the pressure in said section and removing gas from the aerosol, said column being tubular, each of said lenses being of disc shape with an axial opening, and said axial opening being said path.

21. The nozzle of claim 15 wherein said outlet orifice has an outwardly inclined exit.

* * * * *